United States Patent [19]

Samson

[11] Patent Number: 4,815,708

[45] Date of Patent: Mar. 28, 1989

[54] ANTI-SWAY DEVICE FOR A CARPET STRETCHER

[75] Inventor: Ilan Z. Samson, Tel-Aviv, Israel

[73] Assignee: Roberts Consolidated Industries, Inc., City of Industry, Calif.

[21] Appl. No.: 20,076

[22] Filed: Feb. 27, 1987

[51] Int. Cl.[4] ..... B25B 25/00

[52] U.S. Cl. ..... 254/212; 254/200

[58] Field of Search ..... 254/201, 204, 205, 206, 254/207, 209, 210, 211, 212, 200

[56] References Cited

U.S. PATENT DOCUMENTS

| | | | |
|---|---|---|---|
| 225,273 | 3/1880 | Dice | 254/206 |
| 2,606,743 | 8/1952 | Owens | 254/212 |
| 3,917,225 | 11/1975 | Payson | 254/212 |
| 4,003,549 | 1/1977 | Sergerie | 254/212 |
| 4,076,213 | 2/1978 | Payson | 254/210 |
| 4,538,846 | 9/1985 | Alexander | 254/209 |
| 4,577,837 | 3/1986 | Berg | 254/212 |

*Primary Examiner*—David Werner
*Assistant Examiner*—Katherine Matecki
*Attorney, Agent, or Firm*—Harris, Kern, Wallen & Tinsley

[57] ABSTRACT

A hand powered carpet stretcher is provided with the improvement of an anti-sway device to prevent lateral or transverse movement of the stretcher tubes during stretching while permitting sideways relocation and longitudinal adjustments of the stretcher between stretching operations. The anti-sway device comprises connecting means for rotatably connecting the stretcher tubes to the head and tail block of the stretcher and at least one carpet gripper tube which is adapted to be mounted on the stretcher tubes for rotation therewith and is provided with spiked wheels for engaging a carpet surface, the axis of rotation of each spiked wheel being orthogonal to the longitudinal axis of the stretcher tubes.

8 Claims, 2 Drawing Sheets

ANTI-SWAY DEVICE FOR A CARPET STRETCHER

BACKGROUND OF THE INVENTION

This invention relates to an anti-sway device for a carpet stretcher and to a carpet stretcher comprising such a device.

Carpet stretchers, examples of which are described in U.S. Pat. Nos. 3,692,278, 3,441,252 and 1,006,409, commonly comprise a tail block for bearing against a wall, a head that has teeth for gripping a carpet, a shaft or piston member fixed to the head, a cylinder member within which the shaft is slidable, a variable number (depending on the size of the carpet to be stretched) of telescopically interconnectable steel stretched tubes for connecting the cylinder member to the tail block, and a power unit for sliding the head relative to the cylinder member and longitudinally of the stretcher tubes. The power unit typically comprises a lever which is pivoted on the head and is attached to the cylinder member by a pivotable link so that the head is forced forwards when the lever is depressed and retracted when the lever is raised. The stretcher tubes thus serve to transmit compression forces in use.

A disadvantage of the known carpet stretchers is that the stretcher tubes are resiliently flexible and therefore tend to bow or sway sideways during stretching operations, as shown in FIG. 2A, reducing the efficiency of the stretching operation by reducing the compression force transmitted.

It has therefore been proposed to immobilize the stretcher tubes during stretching by bracing them against some heavy object or by fixing to the stretcher tubes a carpet gripper which has teeth or the like for gripping the carpet surface. The former proposal has the disadvantage that the heavy object must be moved each time the carpet stretcher is relocated sideways between stretching operations in order to stretch a different portion of the carpet. With the latter proposal, sideways relocation of the carpet stretcher between stretching operations and/or longitudinal movement of the stretcher tubes during stretching operations may lead to the carpet becoming damaged by the teeth of the carpet gripper.

In a conventional carpet stretcher, the stretcher tubes are telescopically interconnectable and comprise pairs of male and female tubes. the tubes are right circular cylindrical and each female tube has, spaced along the whole of its length, a number of pairs of diametrically opposed hles. The male tubes are of a size to slidingly engage in the female tubes and each is provided with just two pairs of diametrically opposed holes, one pair at each end of the tube. Inside each end of each male tube is a U-shaped spring having two outwardly extending buttons fixed thereto, one at each free end of the "U", for engaging in the pair of diametrically opposed holes of the male tube and a selected pair of holes of a female tube. Thus, the male tubes can be fixed at any desired position relative to the female tubes. In the carpet stretcher described above, the cylinder member comprises one of the female tubes, and the tail block has a single pair of opposed holes for engaging a mal tube. In this arrangement, the stretcher tubes cannot be rotated about their longitudinal axis.

OBJECTS OF THE INVENTION

It is an object of the present invention to enable the provision of an anti-sway device to prevent side-to-side movement of the stretcher tubes during stretching whilst permitting sideways relocation of the stretcher between stretching operations.

It is a further object of the invention to enable the provision of an anti-sway device wherein a carpet gripper for preventing side-to-side movement of the stretcher tubes is movable longitudinally of the strecther tubes to minimize damage to the carpet surface during stretching operations.

It is still further object of the present invention to enable the provision of rotatable connections for carpet stretcher tubes.

It is also an object of the present invention to enable the provision of an anti-sway device in the form of a kit that can be fitted to carpet stretchers currently in use without any substantialy modifications thereto.

SUMMARY OF THE INVENTION

According to the present invention, at least one carpet gripper is provided which is adapted for mounting on one of the stretcher tubes for rotation about the longitudinal axis of the stretcher tubes. Thus, the carpet stretcher can be relocated sideways between stretching operations without damage to the carpet.

Advantageously, the stretcher tubes are rotatable and the carpet gripper is fixed for rotation therewith.

According to another aspect of the invention, a carpet gripper for preventing side-to-side movement of the stretcher tubes is movable longitudinally of the stretcher tubes to minimize damage to the carpet surface during stretching operations.

More particularly, the carpet gripper is adapted for mounting on one of the stretcher tubes for longitudinal movment with the stretcher tubes, and engages the carpet surface by means of spiked wheels which can roll in the direction of longitudinal movement of the stretcher tubes.

A further aspect of the invention provides a rotable connection for carpet stretcher tubes, which rotatable connection comprises a female member having a circular cross-section bore, a circular cross-section male member for slidingly engaging in said bore, said male member being at least partly hollow and provided with a fixed inwardly extending annular beading, and spring means adapted to be disposed in said bore of said female member for resiliently engaging said beading when said male member is slidingly engaged in said bore, said spring means being actuable from outside said female member to release said beading therefrom.

A still further aspect of the invention provides a kit of parts comprising at least one carpet gripper according to the invention, a female member having a circular cross-section bore, a first circular cross-section male member for slidingly engaging in said bore, said first male member being at least partly hollow and provided with a fixed inwardly extending annular beading, first spring means adapted to be disposed in said bore of said female member for resiliently engaging said beading when said first male member is slidingly engaged in said bore, said first spring means being actuable from outside said female member to release said beading therefrom, a second male member substantially identical to said first male member, and second spring means substantially identical to said first spring means.

This kit of parts can be used to modify a conventional carpet stretcher to incorporate the improvement of the invention, the cylinder member of the carpet stretcher itself providing the additional female member that is required to complete the two rotatable connections.

BRIEF DESCRIPITION OF THE DRAWINGS

DETAILED DESCRIPTION OF A PREFERRED EMBODIMENT

Figure 1:
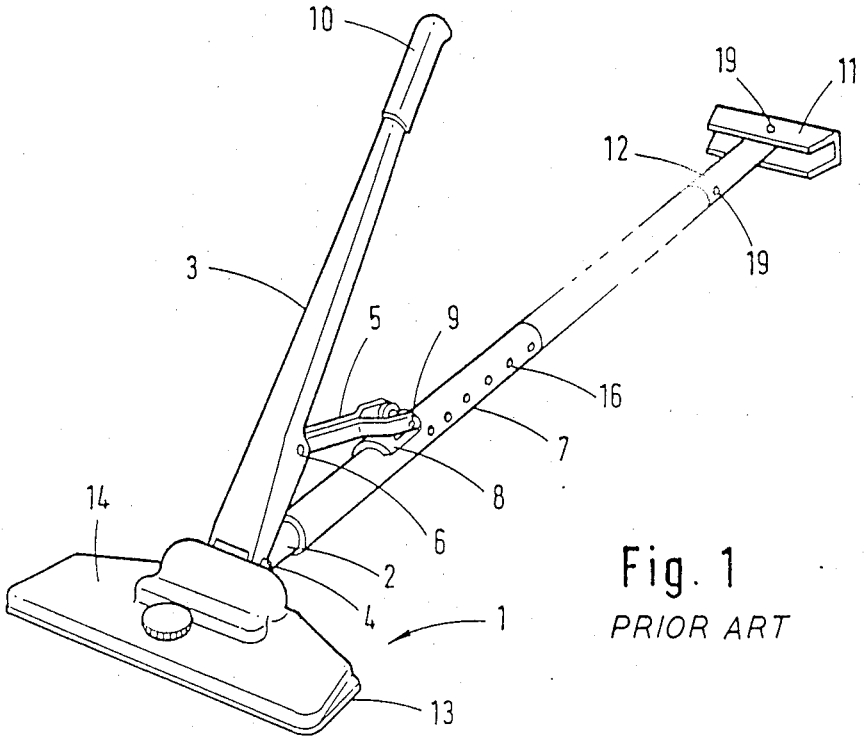
Fig. 1 PRIOR ART
FIG. 1 is a perspective view of a conventional carpet stretcher which is suitable for use with an anti-sway device according to the invention.

Referring now to the drawings, FIG. 1 shows a hand powered carpet stretcher that comprises a head 1 having teeth (not shown) which engage the carpet and a shaft 2 which is fixed to the head 1. A lever 3 is pivotally connected to the head 1 by a pin 4. The lever 3 is pivotally connected to a link member 5 by a pin 6 and the opposite end of the link member 5 is pivotably secured to a base member 7 by a bracket 8 and pin 9. The lever 3 is additionally provided with a handle 10.

The base member 7 comprises a cylinder member which has a diameter to mate with the stretcher tubes commonly used in carpet stretcher assemblies. These are stainless steel tubes that fit together. The larger tubes are 1.785 inches outside and 1.645 inches inside diameter and the smaller tubes which fit within them are 1.625 inches outside diameter and 1.495 inches inside diameter in a typical assembly. The manner in which these tubes are interlocked with each other and with the cylinder member 7 will be described hereinbelow.

The cylinder member 7 supports the bracket 8 and slidably receives the shaft 2. Also, a tail block 11 of U-shaped cross section engages a conventional male stretcher tube 12 in a manner to be described hereinbelow.

Any suitable materials and fixing methods may be used in the construction of the carpet stretcher. However, typically the head 1 comprises a foot plate 13 cast from aluminium or a similar metal which hardened steel teeth embedded therein and a casing 14 cast from a rigid synthetic metal such as an iron alloy and may be coated or painted. The handle 10 is moulded from rubber or a synthetic plastics material and the bracket 8 and the tail block 11 will typically be cast from aluminium or a similar metal. The shaft 2, cylinder member 7 and stretcher tubes will comprise stainless steel. The individual components of the carpet stretcher may be joined by means of screws, welds, rivets and/or any other conventional means. In one embodiment of a carpet stretcher, the lever 3 and shaft 2 are not connected directly to the foot plate 13 but to an adaptor relative to which the foot plate 13 can swivel in an horizontal plane. The carpet stretcher may also incorporate any of the known features described in, for example, U.S. Pat. No. 3,692,278, the disclosure of which is incorporated herein by reference.

Figure 3:
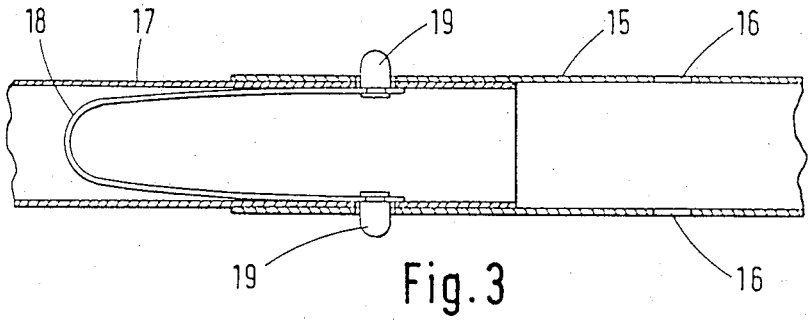
Fig. 3 PRIOR ART
FIG. 3 is a cross-sectional view of the connection between two conventional stretcher tubes.

Turning now to FIG. 3, the connection between a pair of conventional stretcher tubes is illustrated. The female tube 15 has, spaced along the whole of its length, a number of pairs of diametrically opposed holes 16. The male tube 17 is of a size to slidingly engage in the female tube 15 and is provided with just two pairs of diametrically opposed holes, one pair at each end of the tube 17 (only one end of the male tube 17 is illustrated). Inside each end of the male tube 17 is a U-shaped steel spring 18 having two outwardly extending stainless steel spring buttons 19 fixed (e.g. welded) thereto, which engage in the holes of the male 17 and female 15 tubes as shewn. Thus, the male tube 17 can be fixed at any desired position relative to the female tube 15, by selecting the appropriate pair of holes 16 in the female tube 15.

Referring again to FIG. 1, by way of example, the cylinder member 7 is connected to one end of a male stretcher tube 17 as shown in FIG. 3, and the other end of the male tube 17 is connected to a female stretcher tube 15 as shewn in FIG. 3. Obviously the male tube 17 may extend a considerable way into the female tube 15 rather than being engaged with the endmost pair of holes 16 as shewn. The free end of the female tube 15 engages a further male tube 12, again exactly a shewn in FIG. 3, the free end of the further male tube 12 being connected to the tail block 11 as shewn in FIG. 1 by means of a pair of opposed holes in the tail block itself.

Figure 2A:
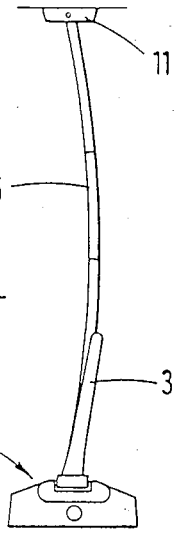
Fig. 2A PRIOR ART
FIG. 2A is a schematic plan view of the carpet stretcher of FIG. 1 in normal use.

FIG. 2A illustrates the conventional carpet stretcher of FIG. 1 in use, shewing the undesirable side-to-side movement of the stretcher tubes, which reduces the effective carpet stretching force. According to the invention, this problem is overcome by connecting the conventional stretcher tubes to the cylinder member 7 and the tail block 11 in a rotatable manner as will be described hereinbelow with reference to FIG. 4 and by mounting carpet gripper tubes on the conventional stretcher tubes as will be described hereinbelow with reference to FIGS. 5 and 6.

Figure 4:
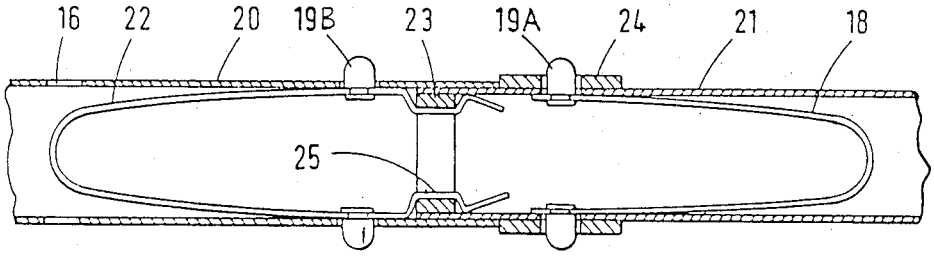
FIG. 4 is a cross-sectional view of a rotatable connection according to the invention.

Turning then to FIG. 4, a rotatable connection is established by means of a female member 20, a male adaptor member 21 and a specially adapted spring means 22 disposed in the female member 20. The female member 20 has the same basic specification as a conventional cylinder member 7 or femal stretcher tube 15, although it can be considerably shorter, having as few as two pairs of holes 16. The male adaptor member 21 has the same basic specification as a conventional male stretcher tube 17 and one end (not shown) remains unmodified. The other end has, however, been modified by the addition of an internal fixed annular beading 23 at or adjacent the end of the tube 17 and an external abutment means 24 in the form of a short tube which engages the spring buttons 19 of the male adaptor member 21 by means of diametrically opposed holes therein. The beading 23 and abutment means 24 may be made from any suitable metal such as hardened steel and cast aluminum respectively.

The spring means 22 corresponds to a conventional U-shaped spring 18 of the type shewn in FIG. 3 which has been modified in that the arms of the 'U' extend beyond the spring buttons 19 and include a detent 25 for engaging the annular beading 23 of the male adaptor member 21. The spring means 22 can be actuated to engage and disengage the bearing 23 from outside the female member 20 by pressing the spring buttons 19. Thus, the male 21 and female 20 members can be rotatably engaged with the abutment means 24 abutting the end of the female member 20. Abutment means 24 and buttons 19A serve to transmit compressional forces, whilst beading 23, spring 22 and buttons 19B serve to prevent the assembly from coming apart when pulled along.

It will be appreciated that, where the rotatable connection shewn in FIG. 4 is used to connect the cylinder member 7 to a conventional stretcher tube, the female member 20 is the cylinder member 7 and the male adaptor member 21 is connected at its free end (not shown) to a conventional female stretcher tube 15. Also, where the tail block 11 is to be connected to a conventional stretcher tube using the rotatable connection, the female member 20 may be a conventional female stretcher tube 15, the corresponding male tube 17 having been discarded, but is more usually a specially provided short female tube or sleeve member 20 having ohnly a few pairs of holes 16. The male adaptor member 21 is connected at its free end (not shown) to the tail block 11 in the conventional manner, the conventional male stretcher tube 12 which would normally be connected to the tail block 11 being discarded.

Thus, the only additional parts required to incorporate two rotatable connections into a conventional carpet stretcher are two male adaptor members 21 and two special spring means 22, although it is usually preferred to additionally provide a short sleeve member 20 to act as the female member in the connection to the tail block 11.

Figure 6:
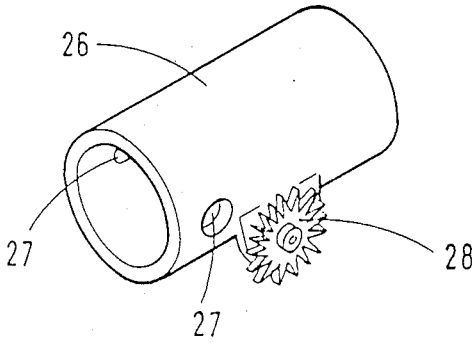
FIG. 6 is a perspective view of a carpet gripper tube according to the invention.

A kit-of parts according to the invention will additionally comprise one or more carpet gripper tubes 26 of the type shewn in FIG. 6. Each tube is cast in aluminium and has an internal diameter slightly larger than the external diameter of a female stretcher tube 15 and diametrically opposed holes 27. A pair (only one shown) of spiked wheels 28 is rotatably mounted on either side of the tube.

Figure 5:
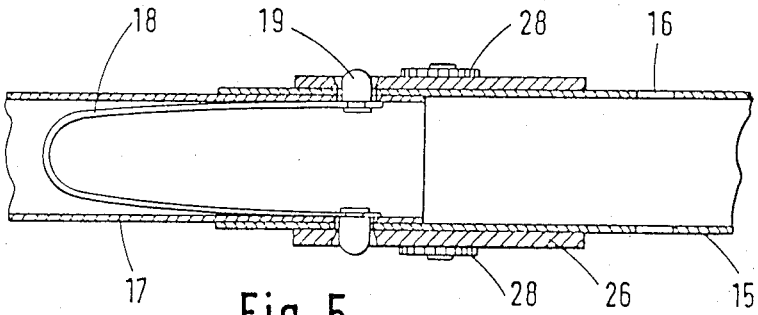
FIG. 5 is a cross-sectional view of the connection shewn in FIG. 3 but with a carpet gripper tube according to the invention in position.

In use, each carpet gripper tube 26 is mounted on a female stretcher tube 15 at its junction with a male stretcher tube 17 by means of the spring buttons 19 as shewn in FIG. 5.

Thus, by way of example only, a carpet stretching assembly according to the invention can be obtained by modifying the conventional carpet stretcher of FIG. 1 as follows:

Insert one of the special spring means 22 into the cylinder member 7 and engages it with one of the male adaptor members 21 as shown in FIG. 4.

Engage the free end of the male adaptor member 21 with a first female stretcher tube 15 as shewn in FIG. 3. The first female stretcher tube 15 is already interlocked with a first male stretcher tube 17, a free end portion of which extends from the end of the first female stretcher tube 15 distal from the male adaptor member 21.

Engage the free end portion of the first male stretcher tube 17 with a second female stretcher tube 15 carrying a carpet gripper tube 26 as shewn in FIG. 5. The second female stretcher tube 15 is already interlocked with a second male stretcher tube 17, a free end portion of which extends from the end of the second female stretcher tube 15 distal from the carpet gripper tube 26.

Engage the free end portion of the second male stretcher tube 17 with the sleeve member 20 in the same manner a shown in FIG. 3.

Insert the other special spring means 22 into the sleeve member 20 and engage it with the other male adaptor member 21 as shown in FIG. 4.

Discard the male stretcher tube 12 which is attached to the tail block 11 and replace it with the other male adaptor member 21 by engaging the free end of the other male adaptor member 21 with opposed holes in the tail block 11.

Obviously, any number of pairs of male 17 and female 15 stretcher tubes may be used, depending on the size of the carpet to be stretched. Advantageously. a carpet gripper tube 26 is placed on every other pair of stretcher tubes.

Figure 2B:
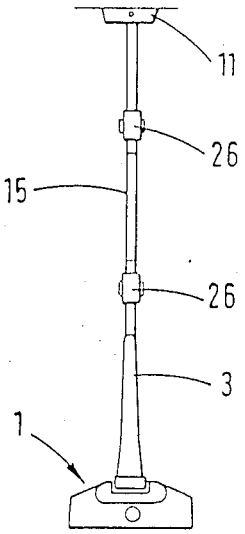
FIG. 2B is a schematic plan view of the carpet stretcher of FIG. 1 in use with an anti-sway device according to the invention.

In use, the carpet gripper tubes 26 prevent side-to-side movement of the stretcher tubes, as shewn in FIG. 2B, by frictionally engaging the carpet surface. Any longitudinal movement of the stretcher tubes during the stretching operations is accommodated by rotation of the spiked wheels 28.

Between stretching operations, the carpet stretcher can be relocated sideways by first rotating the stretcher tubes 26 so that the spiked wheels 28 face up and away from the carpet. The carpet stretcher can then be moved left or right without damaging the carpet surface.

A further advantage of this arrangement is that sideways relocation can be effected by an operator standing at one end of the tube assembly, by rotating the rotatable connection at that end. This rotates the gripper tube(s) 26 so that the spiked wheels 28 push the tube assembly sideways. It is thus unnecessary for the operator to walk the length of the tube assembly each time it is to be relocated sideways.

The invention has been described by reference to a preferred embodiment and it is not intended that it shall be limited to that embodiment but only by reference to those features and their obvious equivalents set forth in the following claims.

I claim:

1. In a carpet stretcher comprising a tail block for bearing against a wall, a head for gripping a carpet surface, an elongate connecting member adapted for connection to said tail block, and a power unit connectable to said head and said connecting member for moving said head longitudinally of said connecting member, whereby said connecting member transmits compression forces to said tail block in use, the improvement consisting of at least one friction means carried on said connecting member for frictionally engaging a carpet surface, said friction means being adapted for mounting on said connecting member for rotation about a longitudinal axis of said connecting member while being carried thereon, said friction means comprising at least one spiked wheel having an axis of rotation substantially orthoganol to said longitudinal axis.

2. The improvement according to claim 1, wherein at least a part of said connecting member is rotatable about said longitudinal axis thereof and said friction means is adapted for mounting on said part of said connecting member for rotation therewith.

3. The improvement according to claim 1, wherein said friction means is adapted for mounting on said connecting member by means of a cylindrical bore extending through said friction means and having a crosssection corresponding to the external cross-section of said connecting member.

4. In a carpet stretcher comprising a tail block for bearing against a wall, a head for gripping a carpet surface, an elongate connecting member adapted for connection to said tail block, and a power unit connectable to said head and said connecting member for moving said head longitudinally of said connecting member, whereby said connecting member transmits compression forces to said tail block in use, the improvement consisting of at least one friction means carried on said connecting member for frictionally engaging a carpet surface, said friction means being adapted for mounting on said connecting member for rotation about a longitudinal axis of said connecting member while being carried thereon, with at least a part of said connecting member rotatable about said longitudinal axis thereof and with said friction means adapted for mounting on said part of said connecting member for rotation therewith, and wherein connecting means are provided for connecting at least one of said power unit to said connecting member and said connecting member to said tail block, said connecting means including a rotatable joint.

5. In a carpet stretcher comprising a tail block for bearing against a wall, a head for gripping a carpet surface, an elongate connecting member adapted for connection to said tail block, and a power unit connectable to said head and said connecting member for moving said head longitudinally of said connecting member, whereby said connecting member transmits compression forces to said tail block in use, the improvement consisting in that at least one friction means is provided for frictionally engaging a carpet surface, said friction means being adapted for mounting on said connecting member for rotation about a longitudinal axis of said connecting member, with at least a part of said connecting member being rotatable about said longitudinal axis thereof and said friction means being adapted for mounting on said part of said connecting member for rotation therewith, and with said rotatable part being rotatable by means of a joint comprising a female member having a circular cross-section bore, a circular cross-section male member for slidingly engaging in said bore, said male member being at least partly hollow and provided with a fixed inwardly extending annular beading, and spring means adapted to be disposed in said bore of said female member for resiliently engaging said beading when said male member is slidingly engaged in said bore, said spring means being actuable from outside said female member to release said beading therefrom.

6. A carpet stretcher comprising:

a tail block for bearing against a wall;

a head for gripping a carpet surface;

a piston member fixed to said head;

a cylinder member within which said piston member is slidable;

a lever member pivotally connected to said head for pivoting about a first axis;

a link member pivotally connected to said lever member for pivoting about a second axis which is spaced from said first axis, the link member being pivotable with respect to said cylinder member about a third axis which is spaced from said second axis, whereby said piston member is slidable relative to said cylinder member by pivoting said lever member;

at least one tubular steel connecting member for connecting said cylinder member to said tail block;

first connecting means for connecting said tail block to a said connecting member and second connecting means for connecting a said connecting member to said cylinder member, said first connecting means comprising a female sleeve member having a circular cross-section bore, a first circular cross-section male member for slidingly engaging in said bore, said first male member being at least partly hollow and provided with a fixed inwardly extending annular beading, and first spring means disposed in said bore of said sleeve member for resiliently and rotatably engaging said beading when said first male member is slidingly engaged in said sleeve member, said first spring means being actuable from outside said sleeve member to release said beading therefrom, an end portion of said sleeve member which is distal from said first male member in use being adapted to nonrotatably engage a said connecting member, and an end portion of said first male member which is distal from said sleeve member in use being adapted to non-rotatably engage said tail block, and said second connecting means comprising a circular cross-section male member for slidingly engaging in said cylinder member, said second male member being at least partly hollow and provided with a fixed inwardly extending annular beading, and second spring means disposed in said cylinder member for resiliently and rotatably engaging said beading when said second male member is slidingly engaged in said cylinder member, said second spring means being actuable from outside said cylinder member to release said beading therefrom, and an end portion of said second male member which is distal from said cylinder member in use being adapted to non-rotatably engage a said connecting member; and at least one friction means for frictionally engaging a carpet surface, said friction means having a body which is adapted for mounting on a connecting member for rotation therewith by means of a circular cylindrical bore extending through said body, and having a crosssection corresponding to the external cross-section of said connecting member, and fixing means for preventing rotation of said body relative to said connecting member, and at least one spiked wheel rotatably mounted on said body and having an axis of rotation which is orthoganol to the longitudinal axis of said circular cylindrical bore.

7. Anti-sway device for use with a carpet stretcher of the type comprising a tail block for bearing against a wall, a head for gripping a carpet surface, a base member relative to which said head is slidable, at least one elongate connecting member adapted for connection between said tail block and said base member, and a power unit for sliding said head relative to said base member and longitudinally of said connecting member, said anti-sway device comprising connecting means for rotatably connecting said connecting member between said tail block and said base member to enable rotation of said connecting member about the longitudinal axis thereof, and at least one friction means being adapted for mounting on said connecting member for rotation therewith.

8. A carpet gripper for use with a carpet stretcher of the type comprising a tail block for bearing against a wall, a head for gripping a carpet surface, an elongate connecting member adapted for connection to said tail block, and a power unit connectable to said head and said connecting member for moving said head longitudinally of said connecting member, the improvement comprising in combination, first means for frictionally engaging a carpet surface, said first means including at least one spiked wheel having an axis of rotation substantially orthoganol to said longitudinal axis; and second means for mounting said first means on said connecting member for rotation about a longitudinal axis of said connecting member while mounted on said connecting member.

* * * * *